US008993022B1

(12) United States Patent
Hertz

(10) Patent No.: US 8,993,022 B1
(45) Date of Patent: Mar. 31, 2015

(54) CARRY OUT BOWL HAVING CONVERTIBLE BASE

(71) Applicant: Allen D. Hertz, Boca Raton, FL (US)

(72) Inventor: Allen D. Hertz, Boca Raton, FL (US)

( * ) Notice: Subject to any disclaimer, the term of this patent is extended or adjusted under 35 U.S.C. 154(b) by 0 days.

(21) Appl. No.: 13/728,994

(22) Filed: Dec. 27, 2012

Related U.S. Application Data

(60) Provisional application No. 61/580,638, filed on Dec. 27, 2011.

(51) Int. Cl.
*B65D 81/34* (2006.01)
*B65D 3/04* (2006.01)

(52) U.S. Cl.
CPC ..... *B65D 3/04* (2013.01)
USPC ..... 426/394; 426/115; 426/410; 220/575; 220/574; 220/631; 220/666; 220/667; 206/115; 206/514; 206/508; 206/509

(58) Field of Classification Search
CPC ..... A47G 19/02; A47G 19/06; A47G 19/065; A47G 19/2261; A47G 19/22; A47G 19/2205; A47G 19/12; A47G 2019/2277; B65D 21/086; B65D 21/08
USPC ..... 220/575, 574.1, 574, 608, 604, 606, 220/623, 631, 628, 629, 666, 609, 522, 220/667; 426/112, 115, 120; 206/509, 219; 222/541.6, 541.7; 215/229
See application file for complete search history.

(56) References Cited

U.S. PATENT DOCUMENTS

| | | | | | |
|---|---|---|---|---|---|
| 2,121,165 | A * | 6/1938 | Slobodkin | 220/574 |
| 2,219,974 | A * | 10/1940 | Bellow | 220/632 |
| 3,028,702 | A * | 4/1962 | St. Cyr | 215/395 |
| 5,423,452 | A * | 6/1995 | Tardif | 220/574 |
| 5,626,256 | A * | 5/1997 | Onneweer | 220/574 |
| 5,722,558 | A * | 3/1998 | Thompson | 220/521 |
| 2005/0127074 | A1* | 6/2005 | Kusuma et al. | 220/6 |
| 2006/0219725 | A1* | 10/2006 | Ferro | 220/666 |
| 2007/0000922 | A1* | 1/2007 | Vovan et al. | 220/4.27 |
| 2012/0210877 | A1* | 8/2012 | Bougdanos | 99/285 |

* cited by examiner

*Primary Examiner* — Rena L Dye
*Assistant Examiner* — Chaim Smith
(74) *Attorney, Agent, or Firm* — Allen D. Hertz, P.A.; Allen D. Hertz

(57) ABSTRACT

A carry out food bowl comprising a bowl and a removable cover. The bowl includes a conversion demarcation, which defines a conversion section. The conversion section includes a portion of a sidewall of the bowl and a bottom portion of the bowl. The user would depress the conversion section inward creating a new bowl support surface, wherein the new support surface tilts an opening of the bowl. A condiment container receptacle can be integrated into the cover to retain a condiment container assembly. This associates the condiment with the contents of the bowl. The bowl and lid can include a stacking interface enabling one to attach a second bowl onto a cover of a first bowl.

20 Claims, 10 Drawing Sheets

CARRY OUT BOWL HAVING CONVERTIBLE BASE

CROSS-REFERENCE TO RELATED APPLICATION

This Non-Provisional Utility application claims the benefit of U.S. Provisional Patent Application Ser. No. 61/580,638, filed on Dec. 27, 2011, which is incorporated herein in its entirety.

FIELD OF THE INVENTION

The present invention relates to a carry out cuisine container and method of use, and more particularly, a carry out bowl having a convertible base, which enables a horizontally oriented configuration for transport and a non-horizontally oriented configuration for use during consumption of the contents therefrom.

BACKGROUND OF THE INVENTION

Carry out food containers are commonly designed having a base or support surface and an upper or access opening defined by a perimeter or upper rim of the container to which a cover can be removably affixed. The base surface is normally parallel with the perimeter. This feature aids in the attachment of a cover onto the upper rim of the bowl. The cover, when attached to the rim of the container additionally enables stacking of two or more containers within a carry out bag.

When the customer arrives at their destination, they typically remove the cover from the bowl and either transfer the contents into a different serving container or eat the contents directly from the carry out bowl. When eating the contents directly out of the carry out bowl, the upper rim of the container defining the opening through which the user accesses the food contained therein is horizontal.

Several cuisines are best consumed by being scooped out of the bowl. One example is a rice dish. The dining party commonly tilts the bowl and draws the edible contents from the bowl using chopsticks.

Meals, such as salads, are commonly served with a side volume of a condiment, such as salad dressing. Adding the condiment to the entré just prior to consumption of the meal is desirous for certain cuisines. Placing salad dressing upon a salad a substantial time prior to consumption of the salad can cause the greens and other ingredients to loose their desired crisp texture over time. Currently, the condiment is stored in a condiment container and placed into the carry out bag. If multiple orders are placed within a single carry out bag, the consumer then needs to match the correct condiment with the associated carry out container. If the condiment and carry out containers are mismatched, the results could be detrimental to the consumer's dining experience.

Accordingly, there remains a need in the art for a carry out container that enables ease of packaging and transport, while also enhancing a dining experience.

SUMMARY OF THE INVENTION

The present invention overcomes the deficiencies of the known art and the problems that remain unsolved by providing a method and respective apparatus for packaging and consumption of take out appetizers, entrees, and desserts.

In accordance with one embodiment of the present invention, the invention consists of a carry out container comprising:

- a convertible bowl comprising:
  - a concave shaped shell defining a content receiving section, the shell having a bottom portion defining a planar support surface, a bowl sidewall extending upwards from a peripheral edge of the bottom surface, and an upper rim circumscribing an upper edge of the bowl sidewall and an opening of the content receiving section, the upper rim defining a stacking plane, wherein the stacking plane and the support plane are substantially parallel to one another;
  - a conversion demarcation defining a conversion section, the conversion demarcation defining an angled bowl support surface encompassing a portion of the bottom portion and a portion of the bowl sidewall; and
- a bowl cover comprising:
  - a cover section having a peripheral edge, and
  - a rim attachment feature formed about the peripheral edge, the rim attachment feature being shaped and shaped for removable attachment between the bowl cover and the convertible bowl to retain contents within the carry out container.

In a second aspect, the conversion demarcation is provided in a "C" shaped cross sectional geometry.

In another aspect, the conversion demarcation is provided in a partially "C" shaped cross sectional geometry.

In another aspect, the apex of the conversion demarcation is oriented towards the content receiving section of the bowl.

In another aspect, the conversion demarcation encompasses a majority of the bottom portion.

In another aspect, the bowl cover further comprises a cover upper surface, wherein the upper surface provides a surface for supporting additional carry out containers.

In another aspect, the bowl cover further comprises a condiment container receptacle, the condiment container receptacle being provided in the cover upper surface.

In another aspect, the condiment container receptacle is contiguous with the cover, maintaining a seal for contents stored within the convertible bowl assembly.

In another aspect, the cover upper surface further comprises a recessed cover section, wherein a surface of the recessed cover section is positioned below a cover upper surface.

In another aspect, the bowl cover further comprises a condiment container receptacle, the condiment container receptacle being provided in the recessed cover section.

In another aspect, the convertible bowl assembly further comprises a condiment container assembly; the condiment container assembly comprises a condiment container and a condiment container cover.

In another aspect, the condiment container assembly comprises a container retention feature and the bowl cover further comprises a condiment container retention mating feature, wherein the condiment container retention feature engages with the container retention mating feature to retain the condiment container with the convertible bowl.

In another aspect, the condiment container retention feature is a recession formed at least partially circumscribing the condiment container and the container retention mating feature is a boss, which engages with the condiment container retention.

In another aspect, the condiment container retention feature is located to position the condiment container assembly enabling stacking of a second convertible bowl assembly upon the first convertible bowl assembly.

In another aspect, the convertible bowl assembly further comprising a recessed bottom surface to accommodate an attached condiment container assembly when stacked the convertible bowl assembly is placed upon a second convertible bowl assembly.

In another aspect, stacking of a first and a second convertible bowl assembly is enhanced by integrating a stacking base interface into the bowl bottom portion and a stacking cover interface into the cover upper surface.

In another aspect, the stacking base interface and mating stacking cover interface comprise a recess and a mating boss respectively.

In another aspect, the stacking base interface and mating stacking cover interface comprise a recessed cylindrical shape and a mating bossed cylindrical shape respectively.

In another aspect, the stacking base interface and mating stacking cover interface comprise a recessed vertically oriented tubular shape and a mating bossed vertically oriented tubular shape respectively.

In another aspect, the stacking base interface and mating stacking cover interface comprise a recessed ring and a mating bossed ring respectively.

Introducing another embodiment, a method of use includes the steps of:

depositing an edible content into a convertible carry out container;

sealing the convertible carry out container by attaching a bowl cover to the convertible carry out container;

depressing a conversion section of the convertible carry out container inward to create a support surface which positions an upper edge of the convertible carry out container to a non-horizontal orientation;

removing the bowl cover from the convertible carry out container;

placing the convertible carry out container upon a support surface; and consuming the edible content from the edible content.

In another aspect, the method further comprises steps of:

depositing a volume of a condiment into a condiment container assembly; and inserting the condiment container assembly into a condiment container receptacle forming within the bowl cover.

In another aspect, the method further comprises a step of:

securing a second convertible bowl assembly onto an upper surface of a first convertible bowl assembly by securing a stacking cover interface and a stacking base interface together.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

Like reference numerals refer to like parts throughout the several views of the drawings.

DETAILED DESCRIPTION

Figure 1:
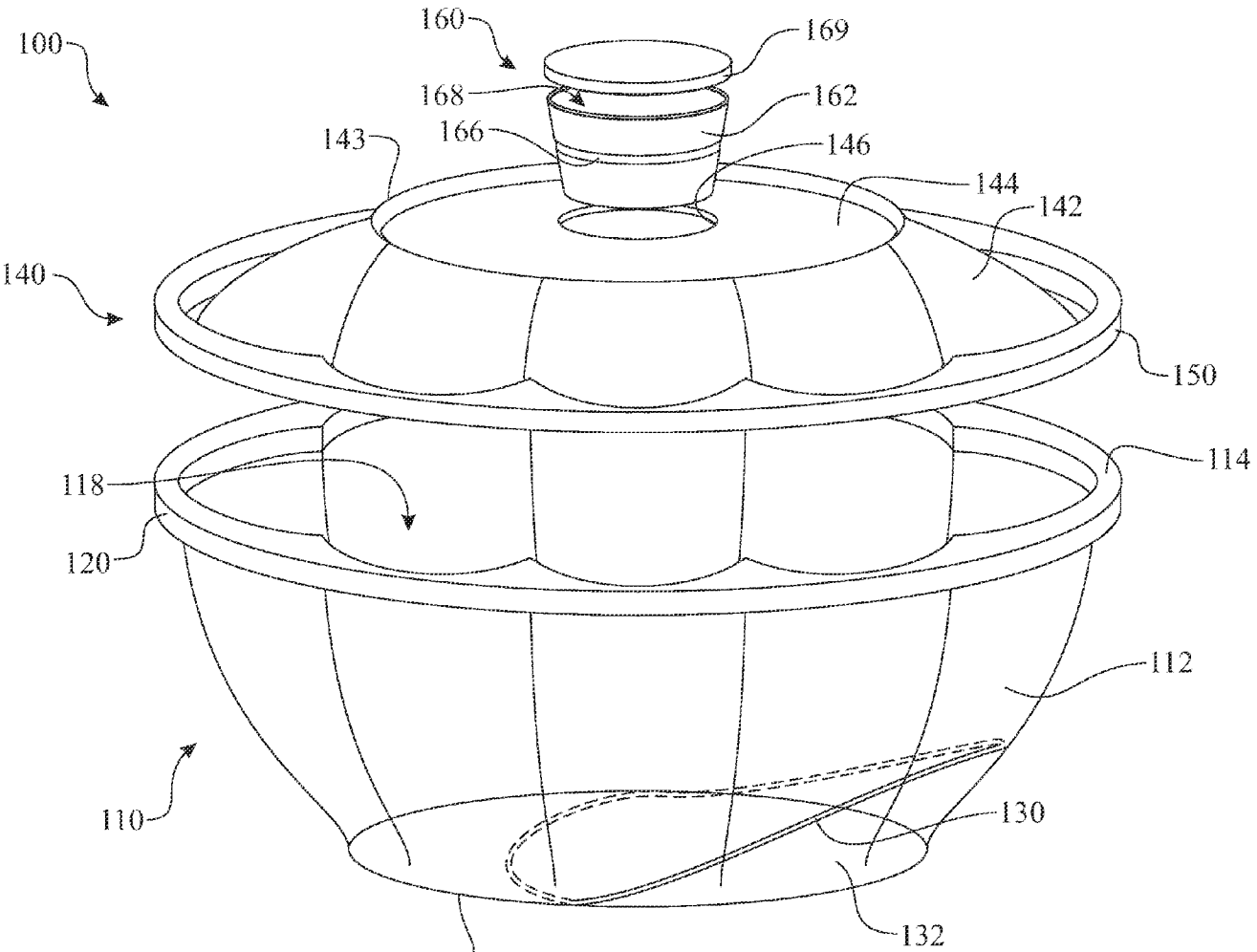
FIG. 1 presents an isometric, exploded assembly view of an exemplary convertible carry out bowl.
Figure 2:
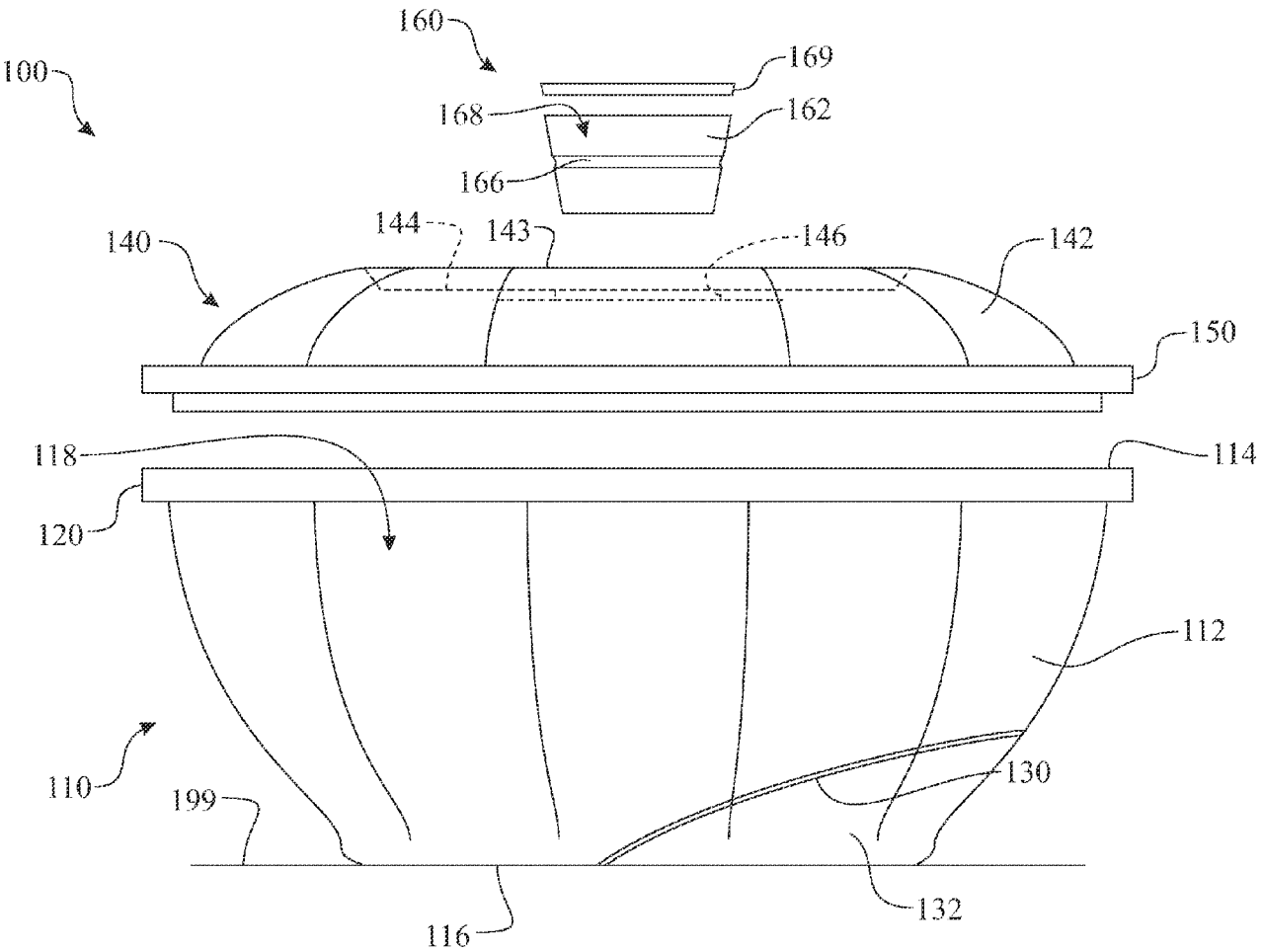
FIG. 2 presents a front, exploded assembly elevation view of the convertible carry out bowl originally introduced in FIG. 1, illustrated in a carry out configuration.
Figure 3:
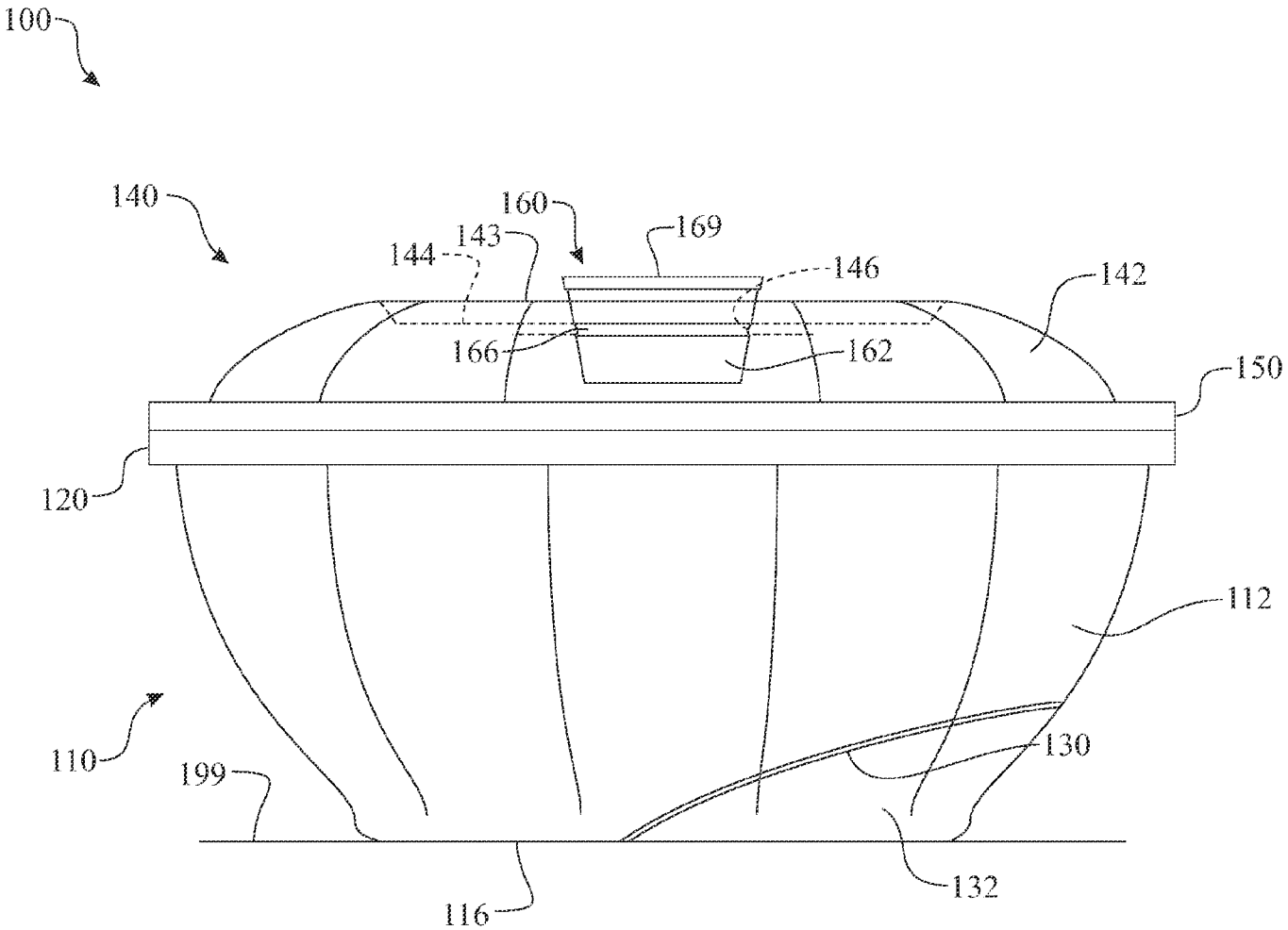
FIG. 3 presents a front, assembled elevation view of the convertible carry out bowl originally introduced in FIG. 1, illustrated in a carry out configuration.
Figure 4:
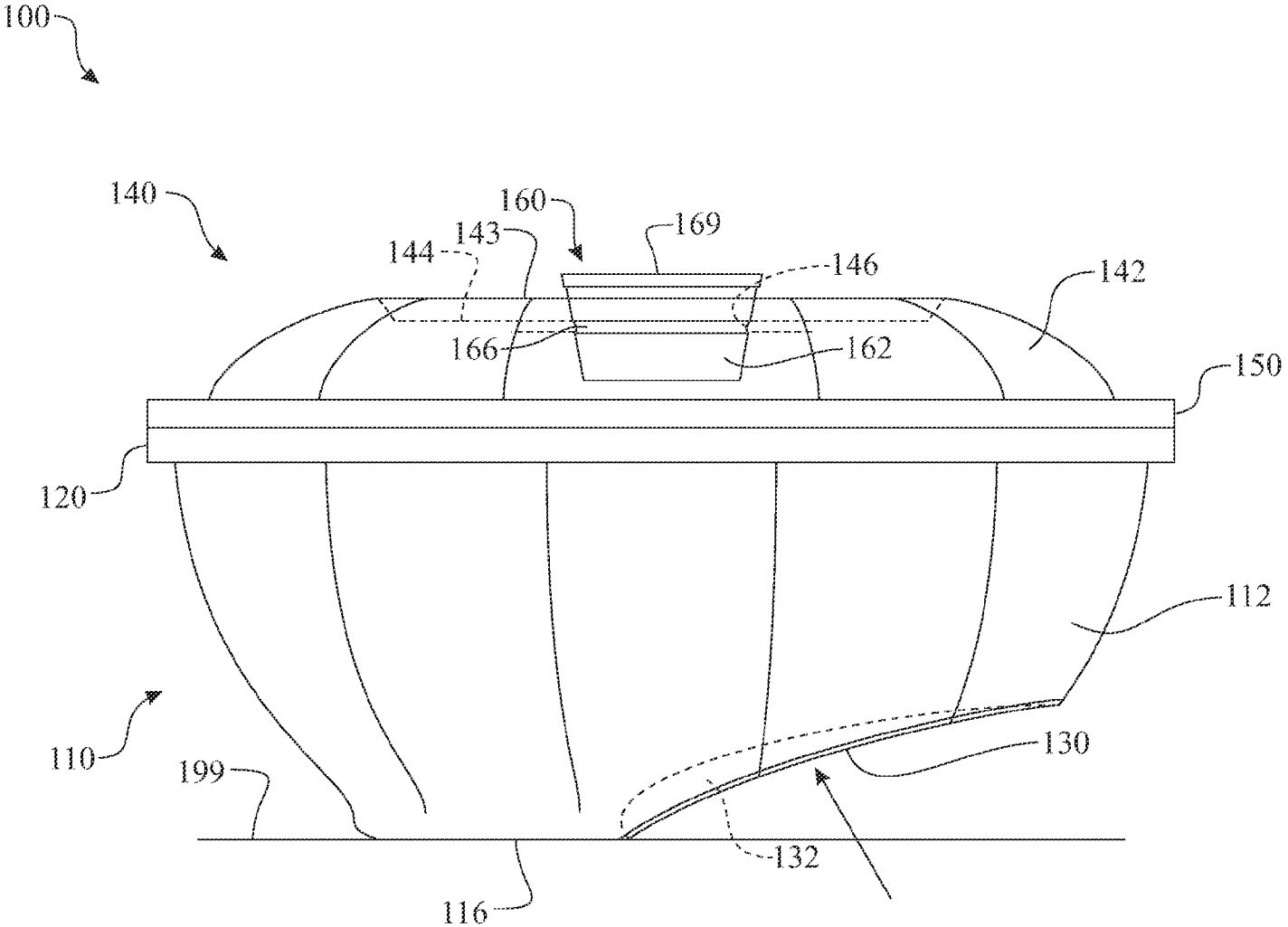
FIG. 4 presents a front, assembled elevation view of the convertible carry out bowl originally introduced in FIG. 1, illustrated in an initial conversion step of being transformed into a tilted configuration, for employment during consumption of edible contents stored therein.
Figure 5:
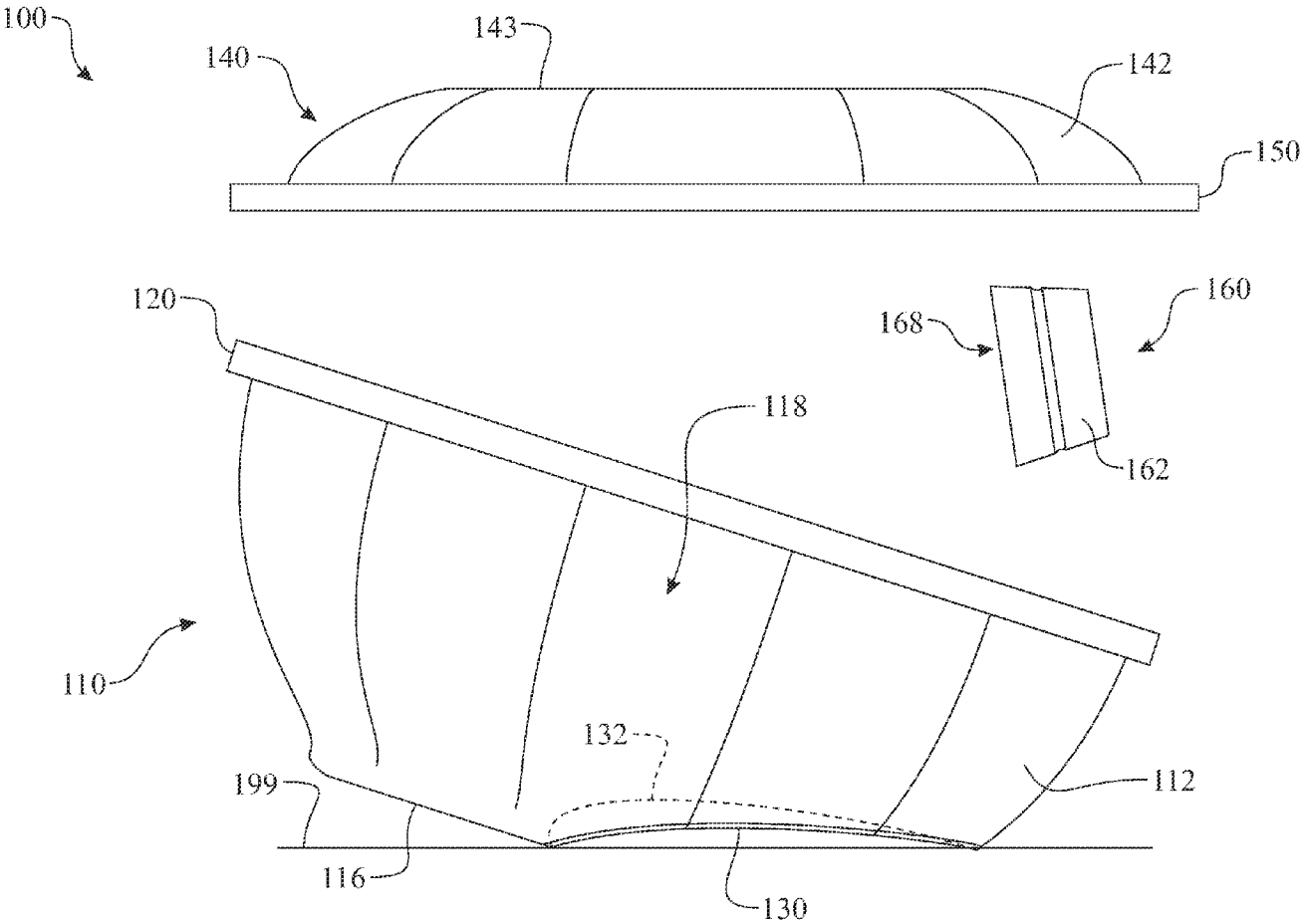
FIG. 5 presents a front, assembled elevation view of the convertible carry out bowl as converted in FIG. 4, illustrating the tilted configuration and positioned for employment during consumption of the edible contents stored therein.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

A convertible bowl assembly 100 is presented in various configurations in the illustrations of FIGS. 1 through 7. The convertible bowl assembly 100 includes a convertible bowl 110 and a bowl cover 140. The convertible bowl assembly 100 can be further enhanced by optionally integrating a condiment container receptacle 148 into the bowl cover 140 for receiving and retaining a condiment container assembly 160.

The convertible bowl 110 comprises a concave shaped shell sidewall 112 extending upward from a peripheral edge of a bowl bottom portion 116 and terminating at an upper opening rim 114. An interior portion of the concave shaped shell sidewall 112 and bowl bottom portion 116 collectively define a bowl content receiving section 118 for storage of edible contents. A conversion demarcation 130 is formed within the convertible bowl 110 wherein the conversion demarcation 130 encompasses a portion of the concave shaped shell sidewall 112 and a portion of the bowl bottom portion 116. The conversion demarcation 130 defines a conversion section 132. It is preferred that the conversion section 132 includes a majority of the bowl bottom portion 116. The conversion demarcation 130 can be a "C" shaped formation or other shape to clearly identify a transition edge. The concave shaped shell sidewall 112 can include optional shaping such as scalloping to enhance the rigidity thereof, the aesthetics, and the like. The bowl bottom portion 116 defines a support surface when the convertible bowl assembly 100 is in a transport configuration. During transport, the bowl bottom portion 116 rests upon a support surface 199.

Figure 6:
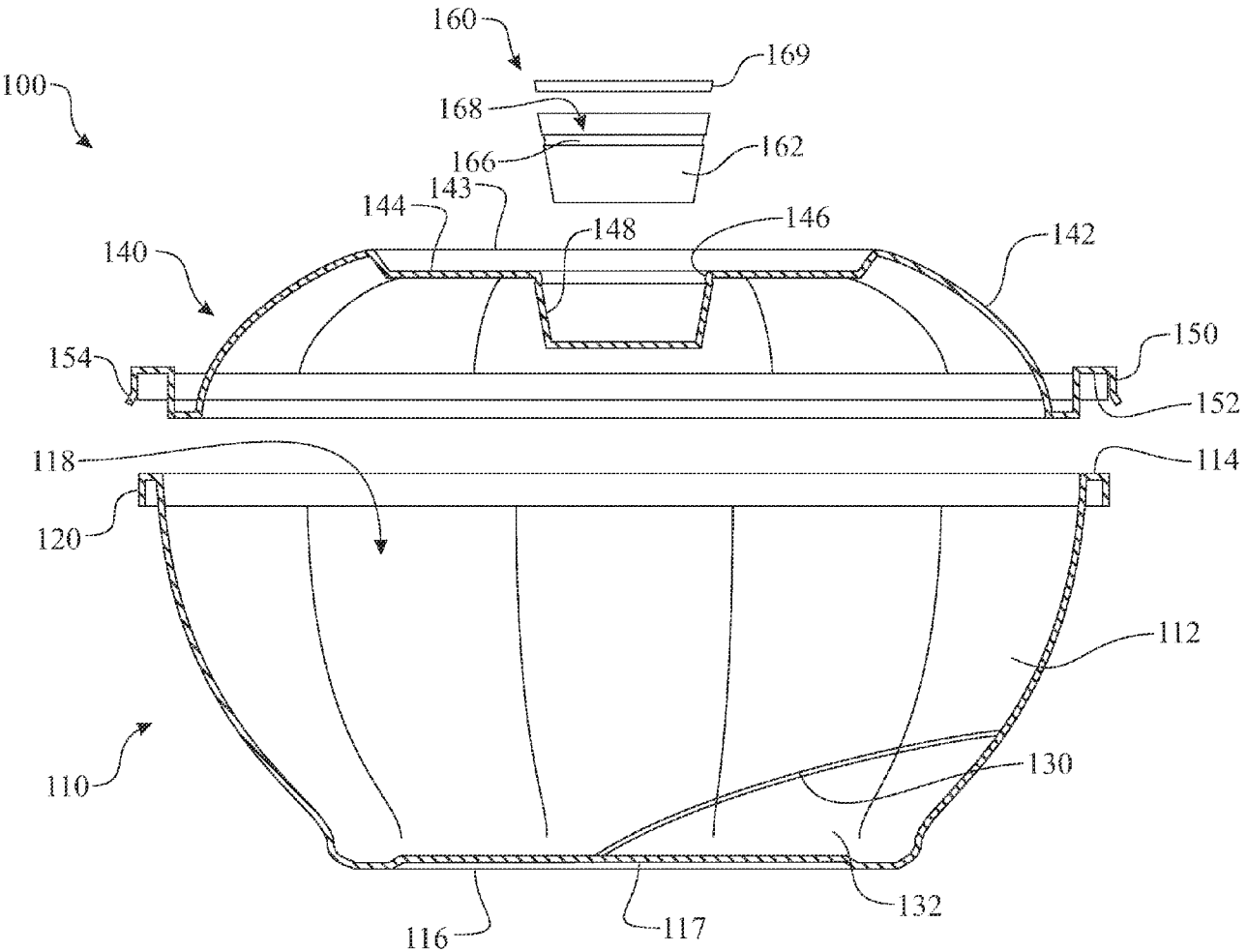
FIG. 6 presents a sectioned exploded assembly side view of the exemplary convertible carry out bowl originally introduced in FIG. 1.
Figure 7:
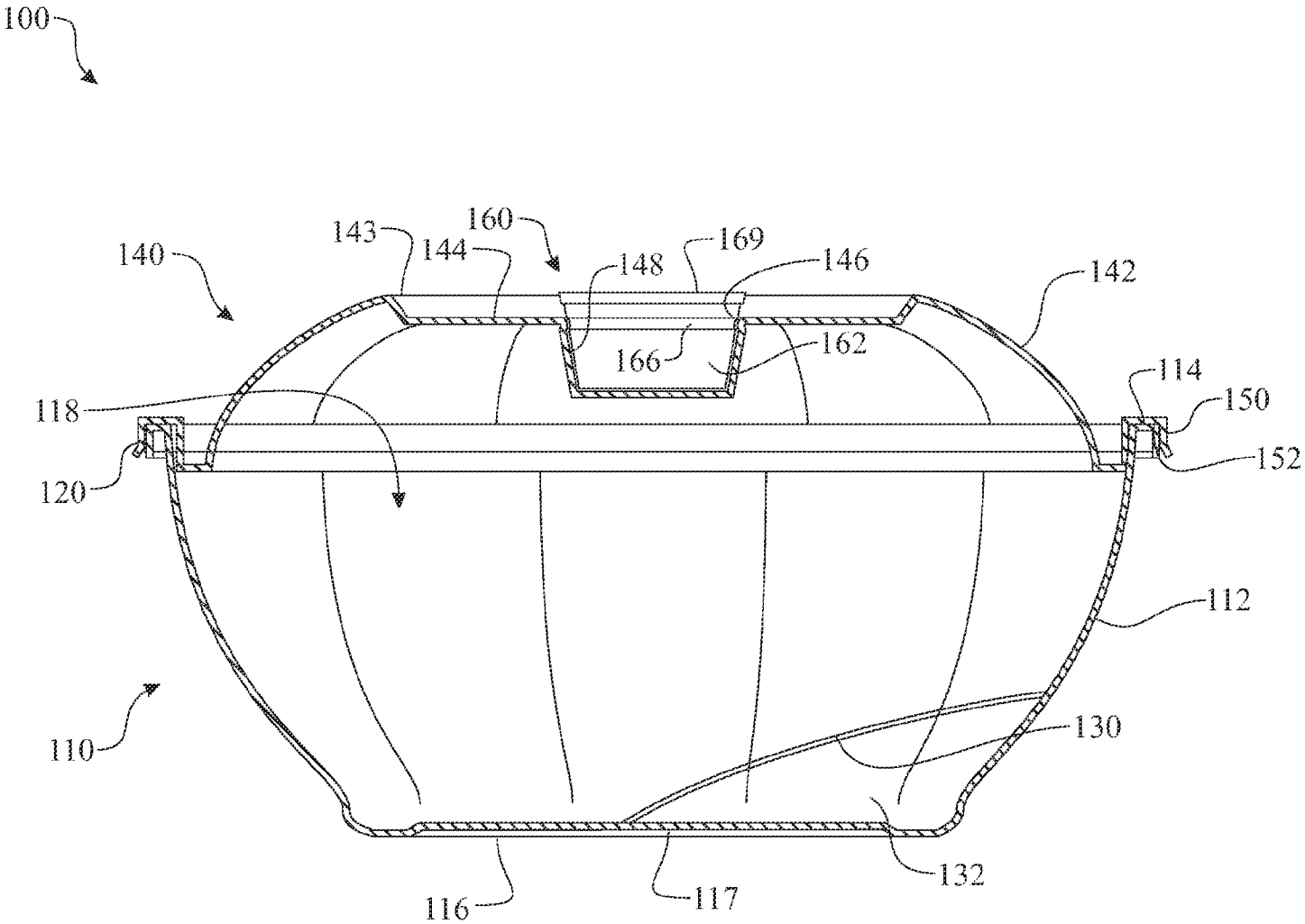
FIG. 7 presents a sectioned assembled side view of the exemplary convertible carry out bowl as previously presented in FIG. 6 with the cover engaged with the bowl rim.

A cover attachment interface 120 is formed about the upper opening rim 114 for receiving the bowl cover 140 as best shown in the cross sectioned illustrations of FIGS. 6 and 7. The cover attachment interface 120 can be formed in any configuration, wherein the exemplary shape is an inverted "U". It is understood that the cover attachment interface 120 can be formed in the shape of a bead, an "L", and the like. The exemplary cover attachment interface 120 is shaped external to the bowl content receiving section 118, as the preferred configuration is easily fabricated using a vacuum forming process.

The bowl cover 140 comprises a cover section 142 extending across an interior defined by a rim attachment feature 150 as best shown in the cross sectioned illustrations of FIGS. 6 and 7. It is preferred that the cover section 142 extends upward forming a concave interior space. A cover upper surface 143 can be integrated into the shape of an upper portion of the curved cover section 142. The cover upper surface 143 defines a planar upper support surface for supporting objects stacked upon the bowl cover 140. The rim attachment feature 150 is shaped to include a rim receiving interface 152. The rim receiving interface 152 is sized and shaped to engage with the cover attachment interface 120. The bowl cover 140 is preferably fabricated using a vacuum forming process and designed to be slightly flexible, enabling releasable engagement between the cover attachment interface 120 and the rim receiving interface 152. A removal assisting lip 154 can extend outward from a lower edge of the rim receiving interface 152 to aid the user in removing the bowl cover 140 from the convertible bowl 110. The removal assisting lip 154 can be provided as a short tab extending from a portion of the peripheral edge of the rim receiving interface 152 or be contiguous about the entire peripheral edge of the rim receiving interface 152.

In use, the convertible bowl 110 is configured with the conversion section 132 extending outward placing the convertible bowl 110 into a portable configuration. The portable configuration orients the upper opening rim 114 horizontally, enabling placement of items onto a top surface of the convertible bowl assembly 100 in a substantially vertical orientation during transport from the restaurant to the dining location. The convertible bowl 110 is converted into a serving container by depressing the conversion section 132 inward towards the bowl content receiving section 118. The concave shaped shell sidewall 112 deforms along the conversion demarcation 130 forming a serving support surface. When served, the conversion demarcation 130 is placed upon the support surface 199. The serving support surface defined by the conversion demarcation 130 supports the convertible bowl 110, placing the upper opening rim 114 at an angle from horizontal. The convertible bowl 110 is rotationally oriented placing the lowest portion of upper opening rim 114 closest to the user. The conversion section 132 may include pleats or other features to aid in collapsing the projected section of the bowl when undergoing the conversion process.

A condiment container assembly 160 can be included with the convertible bowl assembly 100 for storage and delivery of condiments or other additives for application upon or mixing with the stored consumable. The condiment container assembly 160 comprises a condiment container 162 and a condiment container cover 169. The condiment container 162 defines a condiment container contents receptacle 168 for receiving and storing contents therein. The condiment container cover 169 attaches to an upper edge of the condiment container 162 to seal a volume or quantity of the condiments within the condiment container contents receptacle 168. The condiment container 162 and condiment container cover 169 can be provided in any compatible shape.

A condiment container receptacle 148 can optionally be integrated into the upper surface of the bowl cover 140 for receiving and retaining the condiment container assembly 160. In the exemplary embodiment, the cover upper surface 143 further comprises a recessed cover section 144. The recessed cover section 144 is provided to accommodate a portion of the condiment container assembly 160 extending above the surface of the recessed cover section 144. The condiment container receptacle 148 extends downward from the recessed cover section 144. Both, the condiment container receptacle 148 and a sidewall of the condiment container 162 are preferably shaped as an inverted frustum to optimize fabrication as well as fit therebetween.

The condiment container assembly 160 can be retained within the condiment container receptacle 148 by including a retention interface therebetween. In the exemplary embodiment, a condiment container retention feature 166 can be integrated into the condiment container 162 and a container retention mating feature 146 can be integrated into the condiment container receptacle 148. The container retention mating feature 146 can be a ring, a boss, a series of bosses, and the like projecting towards a center of the condiment container receptacle 148. The condiment container retention feature 166 can be a recession formed about a circumference of the condiment container 162. When the condiment container assembly 160 is inserted into the condiment container receptacle 148, the container retention mating feature 146 engages with the condiment container retention feature 166 to retain the condiment container assembly 160 within the condiment container receptacle 148.

A bottom recession 117 can be included within the bowl bottom portion 116, wherein the bottom recession 117 provides sufficient space for the portion of the condiment container assembly 160 extending above the surface of the recessed cover section 144, when a first convertible bowl 110 is placed upon a second convertible bowl assembly 100.

Figure 8:
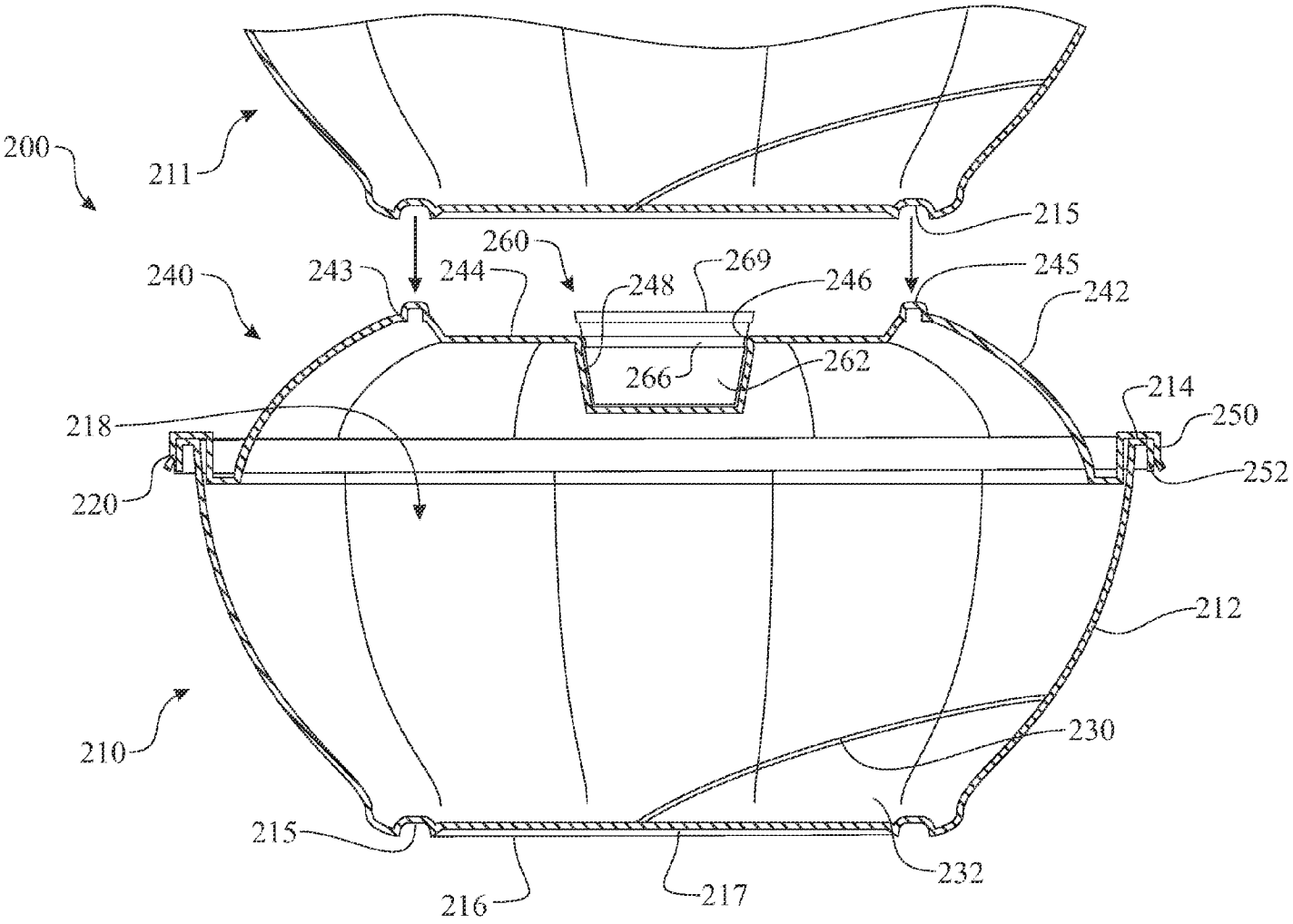
FIG. 8 presents an alternate embodiment convertible carry out bowl introducing an exemplary stacking interface, the illustration presenting a pair of stacked bowls in an exploded assembly view.
Figure 9:
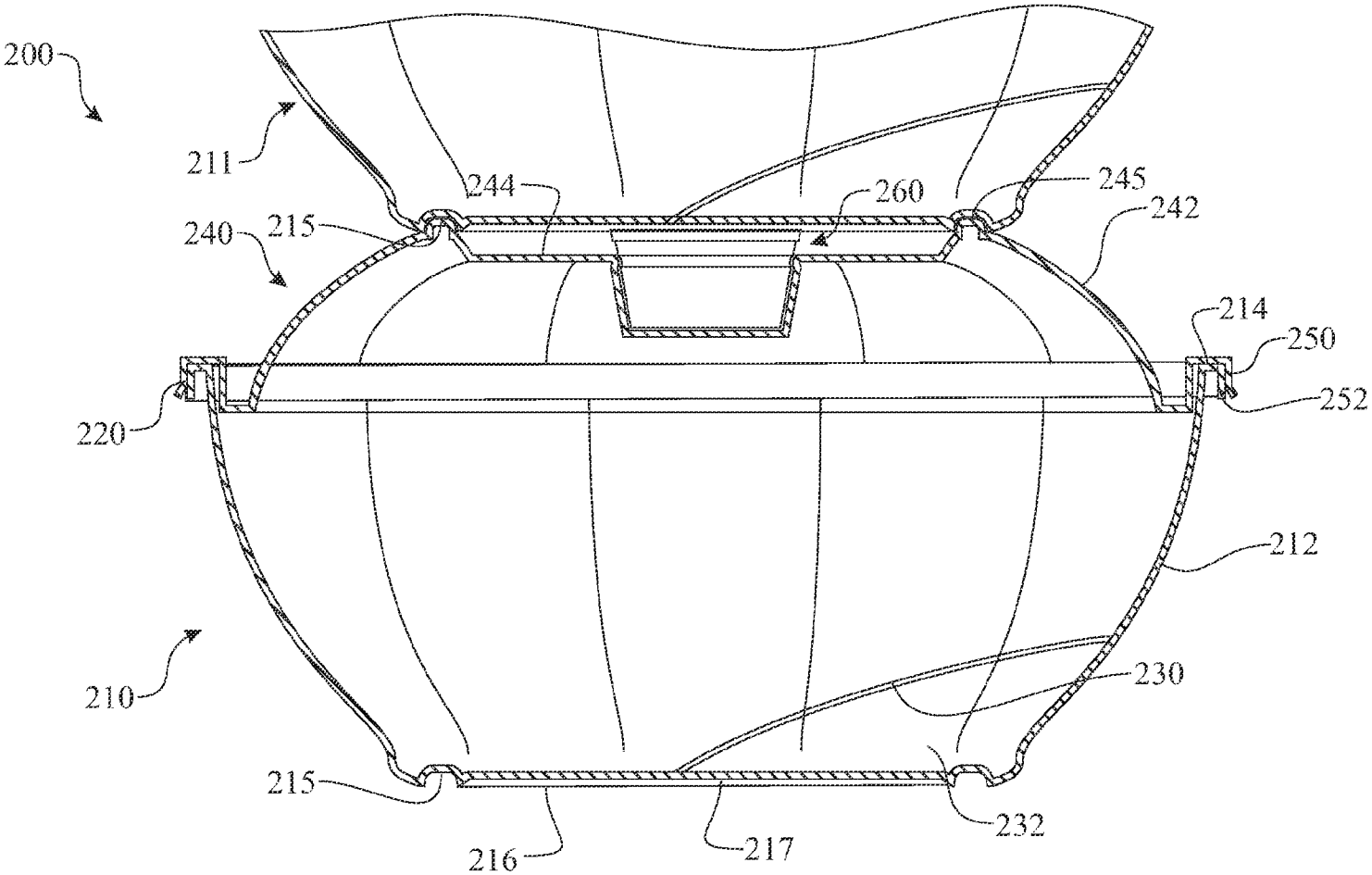
FIG. 9 presents the convertible carry out bowl of FIG. 8, illustrating a pair of bowls in stacked configuration.

An enhanced embodiment of the convertible bowl assembly 100 is presented as a convertible bowl assembly 200 and illustrated in FIGS. 8 and 9. Like features of the convertible bowl assembly 200 and convertible bowl assembly 100 are numbered the same except preceded by the numeral '2'. The convertible bowl assembly 200 includes an interface for aiding and retaining two or more convertible bowl assemblies 200 in a stacked configuration. The exemplary stacking interface includes a stacking base interface 215 shaped in a bowl bottom portion 216 of a convertible bowl 210 and a stacking cover interface 245 shaped into a cover upper surface 243 of a bowl cover 240. The stacking base interface 215 and stacking cover interface 245 can be of any reasonable shape, size, and location to releasably mate together as desired. The stacking base interface 215 and stacking cover interface 245 can be provided in a recessed cylindrical shape and a mating bossed cylindrical shape respectively. The stacking base interface 215 and stacking cover interface 245 can alternately be provided in a recessed vertically oriented tubular shape and a mating bossed vertically oriented tubular shape respectively. In yet another option, the stacking base interface 215 and stacking cover interface 245 can be provided in a recessed ring and a mating bossed ring respectively.

In use, the serving party places edible contents into a bowl content receiving section 218 of the convertible bowl 210. A bowl cover 240 is removably attached to the convertible bowl 210 by engaging a rim receiving interface 252 of the bowl cover 240 with a cover attachment interface 220 of the convertible bowl 210, sealing the contents within the interior volume. Condiments or other additives are placed within an interior of a condiment container 262. The contents are sealed therein by attaching a condiment container cover 269 to an upper edge of the condiment container 262. A condiment container retention feature 266 is formed about a circumference of the condiment container 262. The condiment container retention feature 266 engages with a container retention mating feature 246 formed within a condiment container receptacle 248 of the bowl cover 240. The serving party inserts the condiment container assembly 260 into the condiment container retention feature 266 until the container retention mating feature 246 engages with the condiment container receptacle 248. The engagement between the condiment container retention feature 266 and the condiment container receptacle 248 retains the condiment container assembly 260 within the condiment container receptacle 248. This retains the condiment with the associated edible contents within the respective convertible bowl 210. The process is repeated with a second convertible bowl assembly 200. The second convertible bowl assembly 200 is attached to a bowl cover 240 of a first convertible bowl assembly 200 by engaging the stacking base interface 215 of the second convertible bowl 210 with the stacking cover interface 245 of the first bowl cover 240.

The convertible bowl assembly 100, 200 provides several advantages over the current art. The conversion demarcation 130, 230 enables the user to depress the conversion section 132, 232 to create an angled support surface, wherein the angled support surface tilts the upper opening rim 114, 214. The tilted upper opening rim 114, 214 improves the process of consuming the contents of the convertible bowl 110, convertible bowl 210. Currently condiment containers are placed within a carry out bag without any association with any of the convertible bowls 110, 210. The inclusion of the condiment container receptacle 148, 248 provides an interface for associating the respective condiment container assembly 160, 260 with the contents of the convertible bowl 110, 210. Stacking of a plurality of convertible bowl assemblies 100 can cause undesirable shifting of the convertible bowl assemblies 100 during transport. The convertible bowl assembly 200 provides an additional advantage where a bowl bottom portion 216 of a first convertible bowl assembly 200 is attached to a cover upper surface 243 of a second convertible bowl assembly 200. This eliminates any undesirable shifting during transport.

Figure 10:
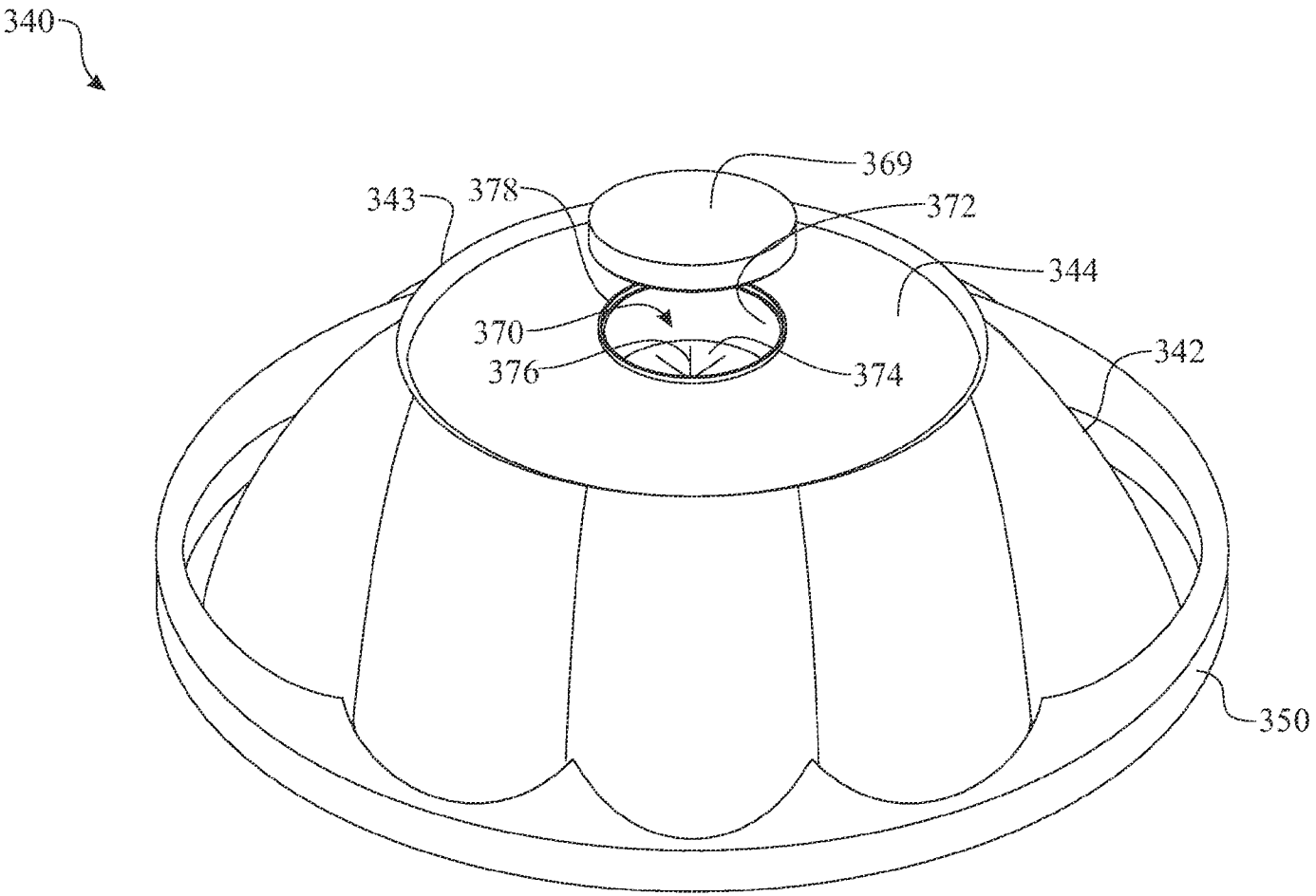
FIG. 10 presents an isometric view of a lid comprising an alternative integrated dressing storage and serving configuration.

A bowl cover 340 integrates a condiment container 370 therein, as illustrated in FIG. 10. The bowl cover 340 is similar to the bowl cover 240, with the introduction of the condiment container 370. Like features of the bowl cover 340 and bowl cover 240 are numbered the same except preceded by the numeral '3'. The condiment container 370 is formed within the upper cover section 344 of the bowl cover 340. The condiment container 370 includes a condiment sidewall 372 extending downward from a peripheral edge of the condiment container 370 formed within the upper cover section 344, and terminating at a condiment container base 374. Condiments, such as salad dressing, ketchup, mustard, tarter sauce, and the like, are dispensed into the condiment container 370. A condiment container cover 369 is secured to the lid coupling rim 378, retaining the condiment within the condiment container 370 until use. A plurality of dispensing grooves 376 is formed in the condiment container base 374. The dispensing grooves 376 enables the user to fracture the condiment container base 374 by applying a compression force onto the condiment container base 374, causing the dispensing grooves 376 to separate. In one method, the user can apply a force using a knife or other kitchen utensil. The fractured dispensing grooves 376 enables the dressing to pass through the condiment container base 374 onto the contents of the bowl. The user can then re-secure the condiment container cover 369 to the lid coupling rim 378 and shake the contents within the bowl to mix the dressing therewith.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

What is claimed is:

1. A carry out container, said container comprising:

a convertible bowl including:

a concave shell, said concave shell having a bottom surface, a planar support surface integral with said bottom surface, and a bowl sidewall extending upwardly from a peripheral edge of said bottom surface, said bottom surface and said bowl sidewall collectively defining a content receiving section, wherein an upper edge of said bowl sidewall forms an upper rim circumscribing and defining an opening of said content receiving section, said upper rim is substantially parallel to said support surface and defining a stacking plane, and a conversion demarcation, said conversion demarcation being a flexible formation that segments the concave shell defining a depressible conversion section, said conversion demarcation substantially defining a plane angularly disposed from said bottom surface and encompassing a combined portion of said support surface and said bowl sidewall, wherein, in a fill configuration, said depressible conversion section is extended outward, away from said content receiving section of said convertible bowl having said convertible bowl resting on said planar support surface and in a consumption condition, said depressible conversion section is depressed inward, towards said content receiving section of said convertible bowl having said convertible bowl resting on said conversion demarcation; and a bowl cover including:

a cover section having a peripheral edge, and a rim attachment feature formed about said peripheral edge, said rim attachment feature shaped for removable attachment to said convertible bowl.

2. A carry out container as recited in claim 1, wherein said conversion demarcation is provided in a "C" shaped cross sectional geometry.

3. A carry out container as recited in claim 1, wherein said conversion demarcation is provided in one of a partial "C" shaped cross sectional geometry and a complete "C" shaped cross sectional geometry.

4. A carry out container as recited in claim 1, wherein an apex of said conversion demarcation is oriented towards said content receiving section of said convertible bowl.

5. A carry out container as recited in claim 1, said bowl cover further comprising a condiment container receptacle, said condiment container receptacle being provided in a cover upper surface.

6. A carry out container as recited in claim 1, said convertible bowl further comprising a stacking base interface and said bowl cover further comprising a stacking cover interface, wherein said stacking cover interface of an upper bowl arrangement engages with said stacking base interface of a lower bowl arrangement to retain said upper bowl and said lower bowl together.

7. A carry out container as recited in claim 1, said bowl cover further comprising a condiment container receptacle, said condiment container receptacle being provided in said cover upper surface, said condiment container receptacle further comprising at least one dispensing groove located in a condiment container base segment of said condiment container receptacle.

8. A carry out container, said container comprising:

a convertible bowl including:

a concave shell, said concave shell having a bottom surface, a planar support surface integral with said bottom surface, and a bowl sidewall extending upwardly from a peripheral edge of said bottom surface, said bottom surface and said bowl sidewall collectively defining a content receiving section, wherein an upper edge of said bowl sidewall forms an upper rim circumscribing and defining an opening of said content receiving section, said upper rim is substantially parallel to said support surface and defining a stacking plane, and a conversion demarcation, said conversion demarcation being a flexible formation that segments said concave shell defining a depressible conversion section, said conversion demarcation substantially defining a plane angularly disposed from said bottom surface and encompassing a combined portion of said support surface and said bowl sidewall, wherein, in a fill configuration, said depressible conversion section is extended outward, away from said content receiving section of said convertible bowl having said convertible bowl resting on said planar support surface and in a consumption condition, said depressible conversion section is depressed inward, towards said content receiving section of said convertible bowl having said convertible bowl resting on said conversion demarcation; and a bowl cover including:

a cover section having a peripheral edge, said cover section extends upward from said peripheral edge, and a rim attachment feature formed about said peripheral edge, said rim attachment feature shaped for removable attachment to said convertible bowl.

9. A carry out container as recited in claim 8, wherein said conversion demarcation is provided in a "C" shaped cross sectional geometry.

10. A carry out container as recited in claim 8, wherein said conversion demarcation is provided in one of a partial "C" shaped cross sectional geometry and a complete "C" shaped cross sectional geometry.

11. A carry out container as recited in claim 8, wherein an apex of said conversion demarcation is oriented towards said content receiving section of said convertible bowl.

12. A carry out container as recited in claim 8, said bowl cover further comprising a condiment container receptacle, said condiment container receptacle being provided in a cover upper surface.

13. A carry out container as recited in claim 8, said convertible bowl further comprising a stacking base interface and said bowl cover further comprising a stacking cover interface, wherein said stacking cover interface of an upper bowl arrangement engages with said stacking base interface of a lower bowl arrangement to retain said upper bowl and said lower bowl together.

14. A carry out container as recited in claim 8, said bowl cover further comprising a condiment container receptacle, said condiment container receptacle being provided in said cover upper surface, said condiment container receptacle further comprising at least one dispensing groove located in a condiment container base segment of said condiment container receptacle.

15. A method of serving food within a convertible, carry out container, said container further comprising a convertible bowl and a bowl cover, said method comprising the steps of:

obtaining said convertible bowl, said convertible bowl including:

a concave shell, said concave shell having a bottom surface, a planar support surface integral with said bottom surface, and a bowl sidewall extending upwardly from a peripheral edge of said bottom surface, said bottom surface and said bowl sidewall collectively defining a content receiving section, wherein an upper edge of said bowl sidewall forming an upper rim circumscribing and defining an opening of said content receiving section, said upper rim is substantially parallel to said support surface and defining a stacking plane, and a conversion demarcation, said conversion demarcation being a flexible formation that segments said concave shell defining a depressible conversion section, said conversion demarcation substantially defining a plane angularly disposed from said bottom surface and encompassing a combined portion of said support surface and said bowl sidewall, wherein, in a fill configuration, said depressible conversion section is extended outward, away from said content receiving section of said convertible bowl having said convertible bowl resting on said planar support surface and in a consumption condition, said depressible conversion section is depressed inward, towards said content receiving section of said convertible bowl having said convertible bowl resting on said conversion demarcation; and obtaining said bowl cover, said bowl cover including:

a cover section having a peripheral edge, and a rim attachment feature formed about said peripheral edge, said rim attachment feature shaped for removable attachment to said convertible bowl;

depositing an edible content into said bowl content receiving section of said convertible bowl;

sealing said convertible carry out container by attaching said bowl cover to said convertible bowl;

depressing said depressible conversion section of said convertible bowl inward to create a support surface which positions an upper edge of said convertible bowl to a non-horizontal orientation;

removing said bowl cover from said convertible bowl;

placing said convertible bowl upon a support surface; and consuming said edible content from said convertible bowl.

16. A method of serving food within a convertible, carry out container as recited in claim 15, further comprising steps of:

depositing a volume of a condiment into a condiment container assembly; and inserting said condiment container assembly into a condiment container receptacle forms within said bowl cover.

17. A method of serving food within a convertible, carry out container as recited in claim 15, further comprising steps of:

depositing a volume of a condiment into a condiment container assembly, said condiment container assembly being located within said bowl cover; and dispensing said volume of said condiment into said bowl content receiving section by creating a fluid passageway through said a base region of said condiment container assembly.

18. A method of serving food within a convertible, carry out container as recited in claim 15, said convertible bowl further comprising a stacking base interface and said bowl cover further comprising a stacking cover interface, said method further comprising a step of:

stacking a pair of containers by engaging said stacking cover interface of an upper container with said stacking base interface of a lower container to retain said upper container and said lower container together.

19. A method of serving food within a convertible, carry out container as recited in claim 18, further comprising steps of:

depositing a volume of a condiment into a condiment container assembly, said condiment container assembly being located between said stacked pair of containers.

20. A method of serving food within a convertible, carry out container as recited in claim 15, further comprising steps of:

depositing a volume of a condiment into a condiment container assembly, and removably securing said condiment container assembly to said bowl cover.

* * * * *